US008113501B2

(12) United States Patent
Uji et al.

(10) Patent No.: US 8,113,501 B2
(45) Date of Patent: Feb. 14, 2012

(54) SHEET SUPPLY DEVICE

(75) Inventors: Nobutaka Uji, Kanagawa (JP); Hiroaki Fujikura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 4 days.

(21) Appl. No.: 11/987,485

(22) Filed: Nov. 30, 2007

(65) Prior Publication Data

US 2008/0290587 A1 Nov. 27, 2008

Related U.S. Application Data

(62) Division of application No. 11/052,761, filed on Feb. 9, 2005, now abandoned.

(30) Foreign Application Priority Data

Jun. 29, 2004 (JP) ..... 2004-191549

(51) Int. Cl.
*B65H 3/14* (2006.01)

(52) U.S. Cl. ..... 271/97

(58) Field of Classification Search ..... 271/97, 271/98, 90, 94, 96
See application file for complete search history.

(56) References Cited

U.S. PATENT DOCUMENTS

| | | | | |
|---|---|---|---|---|
| 5,090,676 | A * | 2/1992 | Matsuno et al. | 271/12 |
| 5,478,066 | A | 12/1995 | Yoshida et al. | |
| 5,893,554 | A * | 4/1999 | Okahashi et al. | 271/98 |
| 6,015,144 | A * | 1/2000 | Yoshii et al. | 271/97 |
| 6,354,585 | B1 | 3/2002 | Takahashi | |
| 6,412,769 | B1 * | 7/2002 | Goda et al. | 271/94 |
| 2004/0089994 | A1 * | 5/2004 | Koga et al. | 271/98 |

FOREIGN PATENT DOCUMENTS

| | | |
|---|---|---|
| JP | 3-211136 | 9/1991 |
| JP | 6-144617 | 5/1994 |
| JP | 11-5643 | 1/1999 |
| JP | 2001-354331 | 12/2001 |

* cited by examiner

*Primary Examiner* — Stefanos Karmis
*Assistant Examiner* — Thomas Morrison
(74) *Attorney, Agent, or Firm* — Morgan, Lewis & Bockius LLP

(57) ABSTRACT

A sheet supply device includes a sheet storing section on which sheets are stacked and are stored; a sheet feed unit controlled by a controller that feeds the sheets stored in the sheet storing section to a next process; and an air blower controlled by the controller that blows air to the sheets stored in the sheet storing section, the air blower has an air nozzle and a mechanism that can adjust a height of the air nozzle in an up-down direction, and the mechanism increases or decreases the air flow rate of the air being blown to the sheets, wherein a force provided by the air blower to push up the sheets is exerted on the sheets, such that a less force is exerted when the sheets are being fed compared to when the sheets are not being fed.

7 Claims, 13 Drawing Sheets

154
70
66
51
71
TP
150B
150
P
150A
152

154
70
66
51
71
TP
150B
150
P
150A
152

154
70
66
71
51
TP
150B
150
P
152
150A

SHEET SUPPLY DEVICE

This is a divisional of application Ser. No. 11/052,761, filed on Feb. 9, 2005 now abandoned, which is hereby incorporated by reference, and claims a benefit of Japanese Patent Applications No. 2004-191549 filed Jun. 29, 2004.

BACKGROUND OF THE INVENTION

1. Field of the Invention

The present invention relates to a sheet supply device.

2. Description of the Related Art

Conventionally, image forming apparatuses such as printers and copying machines generally use cut sheets (copying paper) as a medium on which an image is formed, which cut sheets enable continuous supply. Hitherto, plain paper and woodfree paper specified by manufacturers of copying machines have been used as these sheets (paper). Plain paper and woodfree paper have low smoothness, and thus have weak adhesion. It is thus relatively easily to prevent so-called double feed wherein when sheets are to be supplied one by one from a sheet stacking section such as a sheet feed tray, a plurality of sheets are fed in an adhered state.

In recent years, however, as a result of the diversification of recording media, it has become necessary for various types of sheets including sheets having high surface smoothness to be conveyed. In particular, as coloring techniques are developed, versatile apparatuses that can also or alternatively convey media other than the conventional copying paper, such as enamel paper, the degree of whiteness of which is heightened and to which a glaze is applied (e.g., coated paper, and composite sheet where coating color is applied as one type of a coating material to both surfaces or one surface of a sheet in order to improve suitability for printing), film sheet or tracing paper, are in high demand.

Since these types of coated paper, film sheet and tracing paper have high surface smoothness, the adhesive force between sheets is strong, and thus it is difficult to prevent double feed thereof. For this reason, special measures are necessary for feeding such sheets. For example, the case of coated paper is explained below. As the quality of the coated paper becomes higher, the amount of coating increases, as does the optical property of white glossness. Further, unevenness on the surface of the paper is reduced so that the smoothness of the surface is increased. On the other hand, when the surface smoothness becomes high, the gap between contacting sheets becomes narrow, so that air does not pass through the gap.

As a result, negative pressure is generated and maintained, resulting in strong adhesion between sheets of coated paper. Particularly in cases where coated paper is stacked in a high-humidity environment, sheets of coated paper adsorb to each other so that the degree of adhesion becomes higher. Film sheet and tracing paper have high surface smoothness in themselves, and thus adhesive force between sheets thereof is naturally high and they exhibit the same characteristics in this regard as coated paper.

When these types of smooth sheets with strong adhesion between sheets are to be fed one sheet at a time from a sheet feed tray on which the sheets are stacked, it is very difficult to convey the sheets separately in a device that normally feeds normal paper. In a sheet supply device that uses an engaging roll which contacts with a surface of a sheet at a predetermined pressure and rotates so as to take-in the sheet and a system for pressurizing a supply roll and a separating roll at a constant pressure so as to separate the sheets when the sheets are sorted, a pressurizing force which is about 30 times as strong as that needed to separately convey normal paper is required for conveying smooth sheets separately.

As a method of eliminating the adhesion between the smooth sheets in advance, a technique for blowing air to side surfaces of the stacked sheets has been proposed (see, for example, Japanese Patent Application Laid-Open Nos. 3-211136 (1991) and 11-5643 (1999)).

FIG. 13A, for example, shows a case where air is constantly blown during feeding of the sheets, and FIG. 13B shows a case where an air blowing device is actuated intermittently in synchronous with the feeding of the sheets. In such cases, as shown in FIG. 13C, a sheet P is fed while rubbing against members above the sheet P, such as lift regulating members 564, a nudger roller 556 which has moved upward and a chute member 510, in a state in which an upward-pressing force for pushing up the sheet P is at a maximum. That is to say, the sheet P is fed while the surface thereof is rubbing hard against the lift regulating members 564, the nudger roller 556 and the chute member 510. For this reason, the surface of the sheet P is occasionally damaged.

SUMMARY OF THE INVENTION

The present invention has been devised in view of the above circumstances and provides a sheet supply device that does not damage a sheet surface even when it blows air to ease adhesion between sheets and feed the sheets to a next process.

According to a first aspect of the invention, a sheet supply device includes: a sheet storing section on which sheets are stacked and are stored; a sheet feed unit that feeds the sheets stored in the sheet storing section to a next process; and an air blower that blows air to the sheets stored in the sheet storing section. A force for pushing up the sheets which is exerted on the sheets due to the air blower blowing the air is made to be weaker when the sheets are being fed than when the sheets are not being fed.

According to this aspect, the air blower constantly blows air to the sheets stacked and stored on the sheet storing section, so that adhesion between the sheets is released. The feed unit feeds the sheets to the next process in a state in which the adhesion between the sheets has been released. The force for pushing up the sheets which is exerted on the sheets due to the blowing of the air is weaker when the sheets are being fed than when the sheets are not being fed. Therefore, even when a sheet is fed with the surface thereof rubbing against members above the sheets such as a regulating member that regulates the lift of the sheets, the force pressing the sheet against the regulating member is weak. For this reason, damage to the surfaces of the sheets is minimized, and thus the surfaces of the sheets are unlikely to be damaged.

According to a second aspect of the invention, a sheet supply device includes: a sheet storing section on which sheets are stacked and stored; a feed unit that feeds the sheets stored on the sheet storing section to a next process; an air blower that blows air to the sheets stored on the sheet storing section; and a flow channel moving unit that moves a flow channel for the air blown by the air blower, wherein a height of the flow channel in a vertical direction is set to be higher when the sheets are being fed than when the sheets are not being fed.

According to this aspect, the sheet supply device has a flow channel moving unit that moves a flow channel for the air blown by the air blower, wherein a height of the flow channel in a vertical direction is set to be higher when the sheets are being fed than when the sheets are not being fed. Therefore, even when the sheets are fed with the surfaces thereof rubbing against the members above the sheets such as the regulating members that regulate the lift of the sheets, the force pressing the sheets against the regulating members is weak. For this reason, damage to the surfaces of the sheets is minimized, and thus the surfaces of the sheets are unlikely to be damaged.

According to a third aspect of the invention, a sheet supply device includes: a sheet storing section on which sheets are stacked and stored; a feed unit that feeds the sheets stored on the sheet storing section to a next process; an air blower that blows air to the sheets stored on the sheet storing section; and a flow channel moving unit having an air blocking member that moves in a stacking direction of the sheets so as to block the air, and the air blocking member is moved so that a height of an upper end of the air blocking member is higher when the sheets are being fed than when the sheets are not being fed. According to this aspect, the height of the upper end of the air blocking member is set to be higher when the sheets are being fed than when the sheets are not being fed. As a result, the function of the fifth aspect is effectively achieved.

In short, according to the present invention, even when the air is blown so as to release the adhesion between the sheets and the sheets are fed to a next process, the force pushing up the sheets or the height of the flow channel for the air in the vertical direction is smaller when the sheets are being fed than they are not being fed. Damage to the surfaces of the sheets is, therefore, minimized. Accordingly, the surfaces of the sheets are unlikely to be damaged.

BRIEF DESCRIPTION OF THE DRAWINGS

Embodiments of the present invention will be described in detail based on the following figures, wherein:

FIGS. 13A to 13C are diagrams illustrating a conventional sheet supply device, in which FIGS. 13A and 13B illustrate operation timing between an air blowing device and a feed device, and FIG. 13C is a pattern diagram illustrating a state in which a sheet is fed to a next process with the upper surface thereof rubbing hard against a lift regulating member, a nudger roller in a rest position, and a chute member.

DETAILED DESCRIPTION OF THE INVENTION

An image forming apparatus having a sheet supply device according to embodiments of the present invention will be explained below with reference to the drawings. As an image forming system in the image forming apparatus, a known electrophotographic process is used.

A structure of the image forming apparatus 10 and a summary of image formation will be described first, and a main section of the invention will be explained thereafter. As sheets P on which an image is formed, sheets with a smooth surface are used such as normal paper or coated paper, the surface of which undergoes a coating process in order to provide whiteness and gloss.

Figure 1:
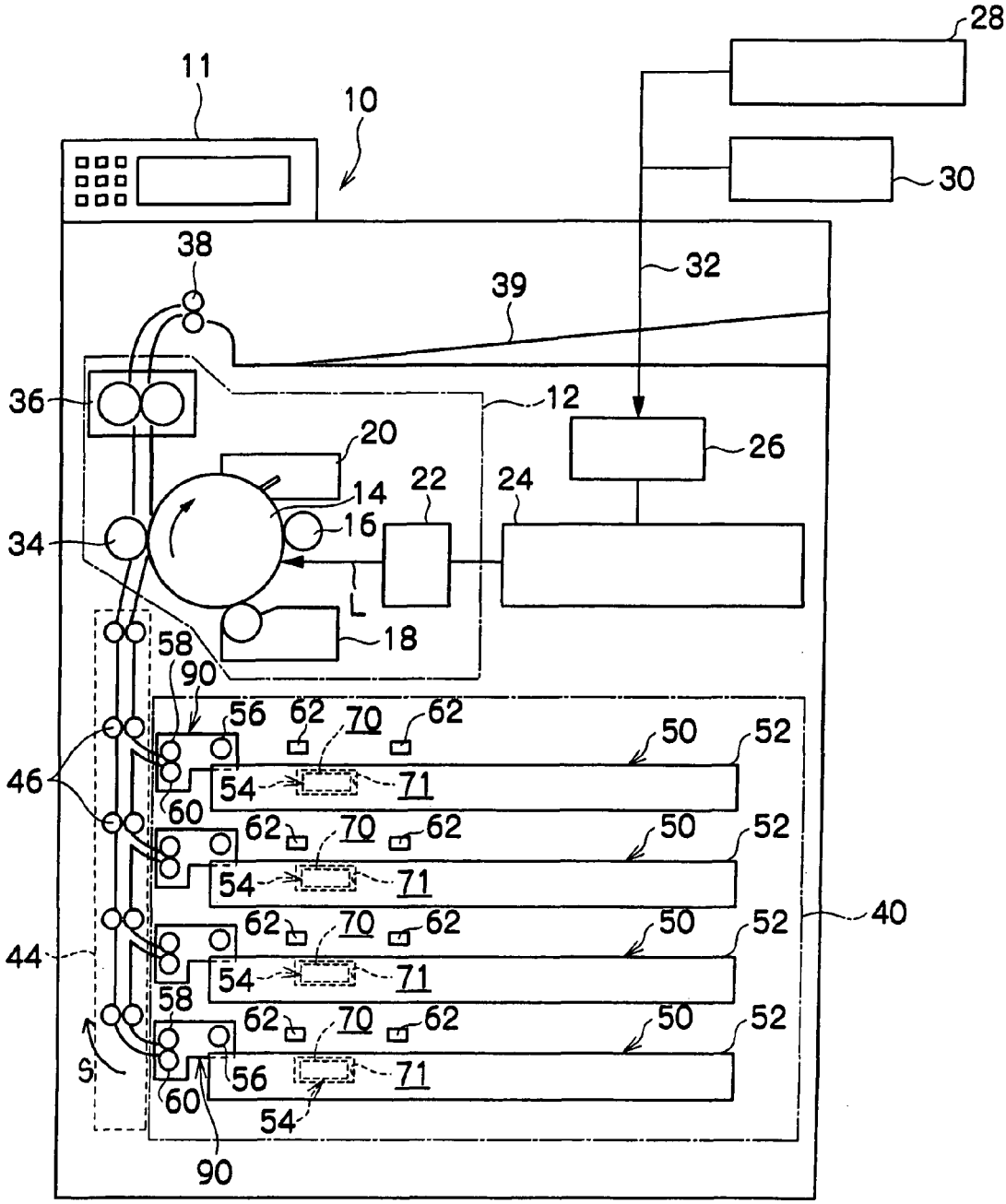
FIG. 1 is a schematic structural diagram illustrating an image forming apparatus having a sheet supply device according to a first embodiment of the present invention.

As shown in FIG. 1, the image forming apparatus 10 has a control unit 24 that controls the entire image forming apparatus 10 and stores various information therein. An operation panel 11 is provided on an upper portion of the apparatus. When a user operates the operation panel 11, the control unit 24 controls the apparatus in accordance with the contents of the peration. The image forming apparatus 10 is further provided with an image forming unit 12 that forms an image using a known electrophotographic process. The image forming unit 12 has a photosensitive drum 14. A charging unit 16, a developing device 18 and a cleaner 20 are disposed along a circumferential direction of the photosensitive drum 14. An image writing device 22 is provided so as to emit a laser beam L to the surface of the photosensitive drum 14 between the charging unit 16 and the developing device 18. A transfer roller 34 is provided at a side of the photosensitive drum 14 opposite to the image writing device 22.

The image writing device 22 is connected to the control unit 24, and the control unit 24 is connected to a receiving unit 26. The receiving unit 26 is connected to external devices such as an image reading device 28 and a personal computer 30 via a communication line 32, and image information is transmitted to the receiving unit 26 from the image reading unit 28 and the personal computer 30. The image information is transmitted from the receiving unit 26 to the control unit 24, and the control unit 24 controls the image writing device 22 based on the image information so that the image writing device 22 emits the laser beam L.

The photosensitive drum 14 is charged by the charging unit 16 so that the surface thereof has a predetermined electric potential. The image writing device 22 emits the laser beam L so that the surface of the photosensitive drum 14 is exposed and an electrostatic latent image is formed thereon. The developing device 18 develops the electrostatic latent image so that a toner image is formed on the surface of the photosensitive drum 14.

A sheet P is transported from a sheet feed unit 40, described below, via a sheet transport unit 44 having plural transport rollers 46 to a nip portion between the photosensitive drum 14 and the transfer roller 34. The transfer roller 34 transfers the toner image on the photosensitive drum 14 to the sheet P, and the sheet P is sent to a fixing device 36 installed downstream in a transport direction, so that the toner image is fixed to the sheet P. A pair of discharge rollers 38 are provided downstream of the fixing device 36 in the transport direction, which discharge the sheet P to which the toner image is fixed onto a discharge tray 39.

The cleaner 20 collects the toner which is not transferred to the sheet P and remains on the surface of the photosensitive drum 14. The sheet feed unit 40, in which plural (four in this embodiment) sheet supply devices 50 are aligned in an up-down direction, is disposed at a lower portion of the image forming apparatus 10. Each of the sheet supply devices 50 has a sheet feed tray 52 on which the sheets P are stacked and stored. A bottom plate (not shown) is provided in the sheet feed trays 52, and is raised and lowered by a driving mechanism (not shown). Due to the raising/lowering of the bottom plate, the stacked sheets P are raised and lowered.

Figure 3:
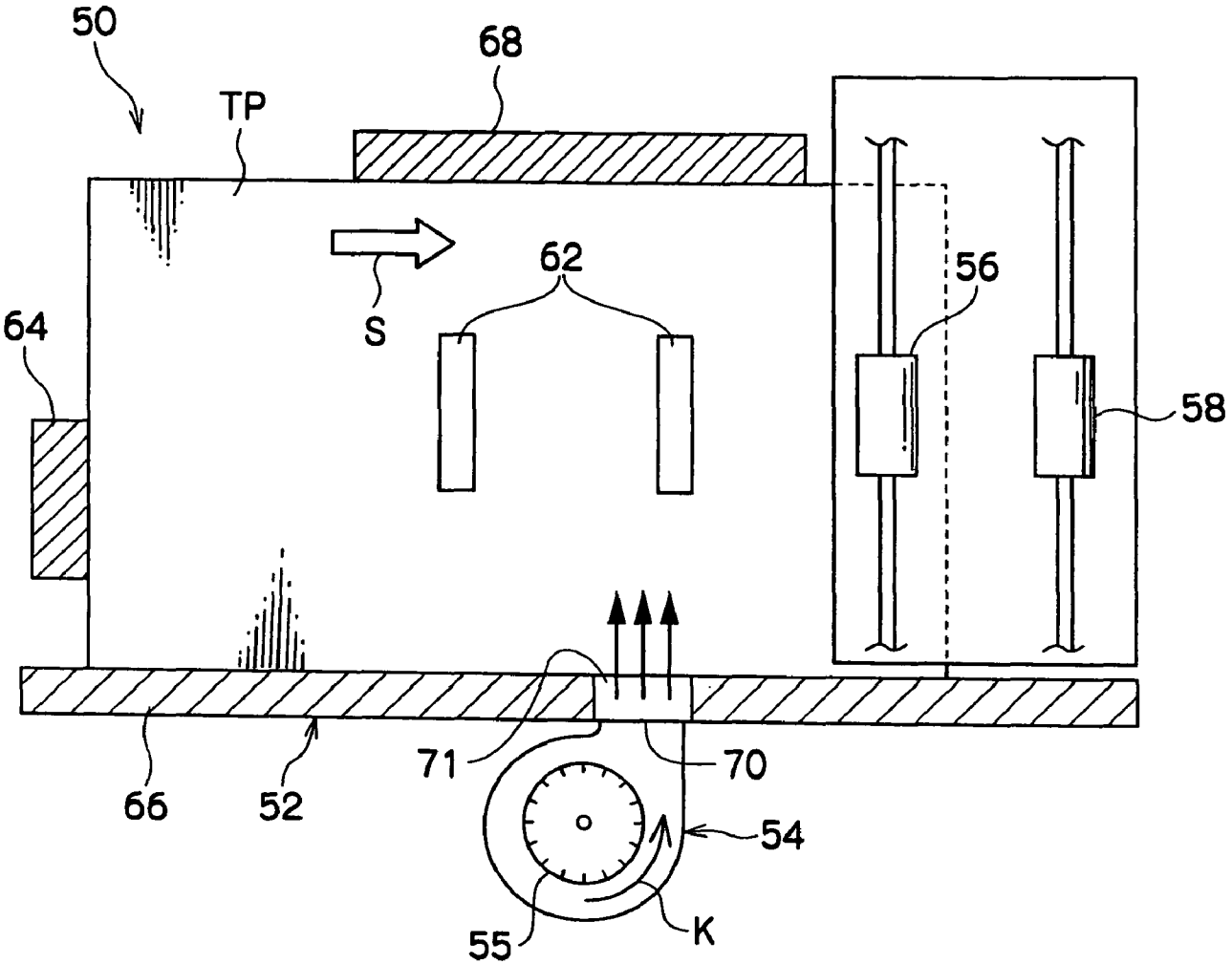
FIG. 3 is a plan view illustrating the sheet supply device according to the first embodiment of the invention.

As shown in FIG. 3, an end guide 64, which can be moved according to the size of the sheets P and regulates a rearward end surface of the sheets P, is provided at an upstream side of the sheet feed tray 52 in a feeding direction S of the sheets P. A side surface fixed guide 66 is disposed at one side surface in a direction perpendicular to the feeding direction S of the sheets P. A side surface movable guide 68, which can be moved according to the size of the sheets P, is disposed at the side surface opposite to the side surface fixed guide 66.

Figure 2:
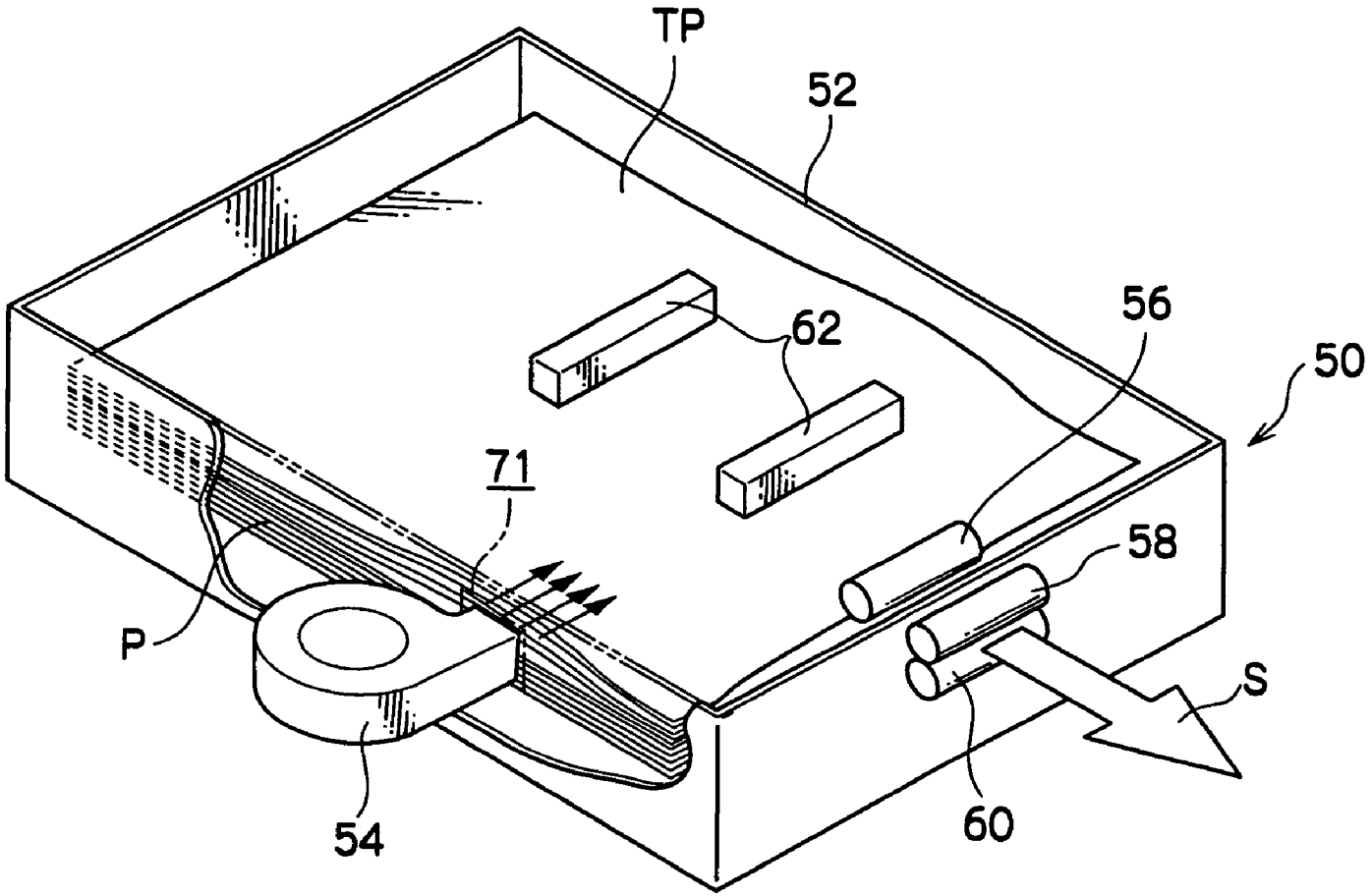
FIG. 2 is a perspective view illustrating the sheet supply device according to the first embodiment of the invention.
Figure 7:
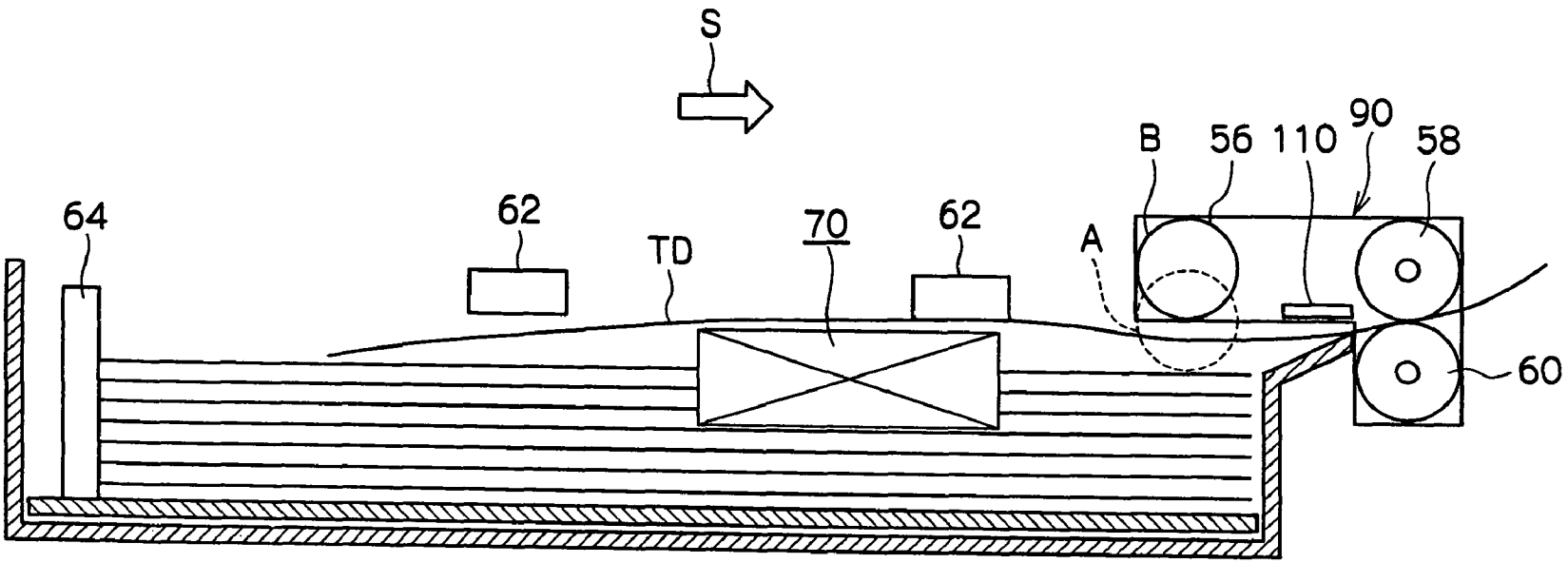
FIG. 7 is a pattern diagram illustrating a state in which a sheet is supplied from the sheet supply device.

As shown in FIG. 1, a feed mechanism 90, which has a nudger roller (drawing-in roller) 56 and sequentially feeds the sheets P to the nip portion between the photosensitive drum 14 and the transfer roller 34 via the sheet transport unit 44, is provided downstream of the sheet feed tray 52 in the feeding direction S. As shown in FIGS. 2 and 3, the nudger roller 56 frictionally contacts with an upper surface of a top sheet TP at the top position of the stacked sheets P so as to sequentially feed the sheets P. The nudger roller 56, as shown in FIG. 7, can be moved to a feeding position A where it contacts with the upper surface of the top sheet TP so as to feed it and to a rest position B where it rests in an upper position. As shown in FIGS. 2 and 3, a feed roller (transport roller) 58 and a retard roller (sorting roller) 60 pressurized by the feed roller 58 are provided downstream side of the nudger roller 56 in the feeding direction S.

Figure 4:
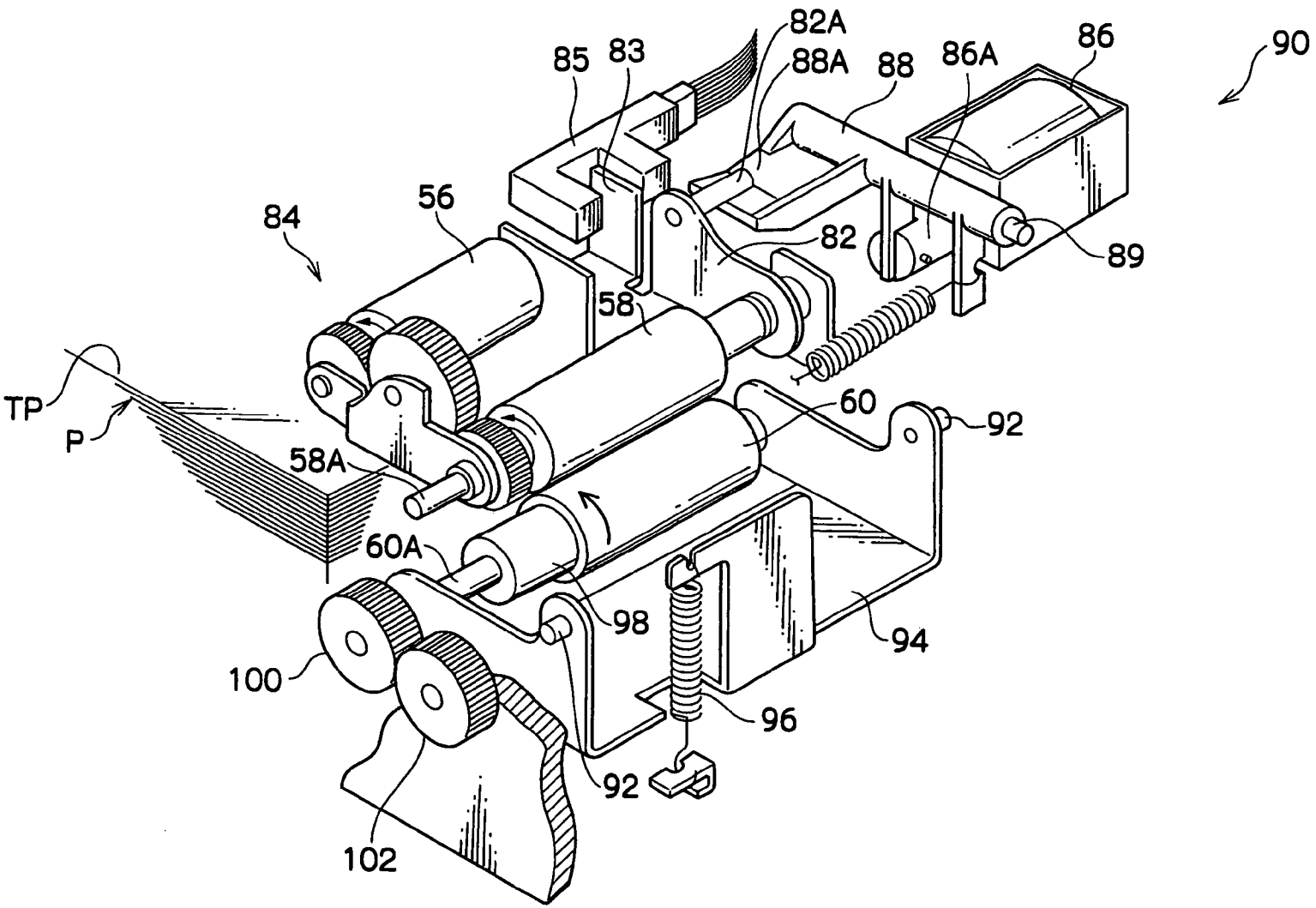
FIG. 4 is a perspective view illustrating a feed mechanism of the sheet supply device according to the first embodiment of the invention.

The nudger roller 56, the feed roller 58 and the retard roller 60 are composed of rollers having the same shape and size, which frictionally contact with the sheets P so as to transport the sheets P. Specifically, the sheets P fed by the nudger roller 56 are sorted into separate sheets by the feed roller 58 and the retard roller 60 and conveyed downstream one sheet at a time. As shown in FIG. 4, the retard roller 60 is pressed against the feed roller 58 with weak pressure by a spring 96 via a support which moves rotationally about a pivot 92. The retard roller 60 is connected to a first gear 100, which moves rotationally via a torque limiter 98 provided on a shaft 60A, and to a fixed second gear 102.

A driving force is transmitted from a feed motor, not shown, to the second gear 102, and the retard roller 60 receives the driving force in the direction of the arrow shown. The nudger roller 56 is structured so as to move rotationally about a shaft 58A of the feed roller 58 via an arm 82, and is rotated by a gear group 84 in conjunction with driving of the feed roller 58. When a plunger 86A moves inward and outward due to an operation of a solenoid 86 which operates on the basis of a driving signal received from the control unit 24 (see FIG. 1), a link 88 rotates around a shaft 89 so as to raise and lower a protrusion 88A.

A pin 82A of the arm 82 is mounted on the protrusion 88A, and moves upward and downward in conjunction with the protrusion 88A. As a result, the arm 82 rotationally moves upward and downward so that the nudger roller 56 moves between the rest position B and the feeding position A (see FIG. 7). In other words, when the protrusion 88A of the link 88 is lowered, the nudger roller 56 descends to the feeding position A where it contacts with the upper surface of the top sheet TP and feeds the top sheet TP by rotatably driving it with a predetermined pressurizing force.

The movement of the arm 82 (nudger roller 56) in the feeding position A is controlled in the following manner. A photosensor 85 detects a protrusion 83 of the arm 82, and the control unit 24 (see FIG. 1) controls raising and lowering of the bottom plate (not shown) so that the height of the top sheet TP falls within a constant range. As shown in FIG. 7, a chute member 110 is provided downstream of the nudger roller 56 to guide the sheets P to the feed roller 58 and the retard roller 60. As shown in FIG. 3, each of the sheet supply devices 50 has an air blowing device 54, which blows air at the side surface of the sheets stacked on the sheet feed tray 52, in a vicinity of the side surface fixed guide 66.

Figure 6:
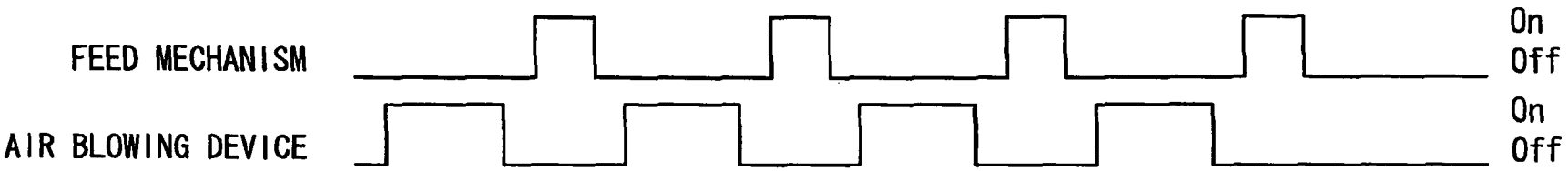
FIG. 6 is a diagram illustrating operation timing between an air blowing device and a feed mechanism of the sheet supply device according to the first embodiment of the invention.

The air blowing device 54 has a fan 55 which rotates in a direction shown by an arrow K, and high-pressure air is blown from a nozzle 70 of the air blowing device 54 and through a nozzle 71 formed at the side surface fixed guide 66. When the air is blown to the sheets P, the air is sent between the stacked sheets P so that the sheets P lift, and the adhesion between the sheets P is released. The air blowing device 54 is controlled by the control unit 24 so that an operation and a non-operation are repeated for predetermined periods, for example, as shown in FIG. 6. The nozzles 70 and 71 have approximately the same size, and their positions are approximately the same.

More specifically, the number of revolutions of the fan 55 can be changed and is set so as to be lower when the sheets are being fed than when the sheets are not being fed. That is to say, the air flow rate of the air blower 54 is set to be lower when the sheets are being fed than when the sheets are not being fed, and the force pushing up the sheets is made weaker when the sheets are being fed than when the sheets are not being fed.

This feature that an air flow rate of the air blower is set at a lower rate when the sheets are being fed than when the sheets are not being fed, of the present embodiment, may be applied to the other embodiments described below. As shown in FIGS. 2, 3 and 7, two lift regulating members 62 are provided upstream of the nudger roller in the feeding direction S of the sheets P, which contact against the top sheet TP when it lifts due to the air and thus regulate the lift of the sheets P. The function of the sheet supply device 50 according to the invention is explained below. When feeding the sheets P, as shown in FIGS. 4 and 5A to 5C, the solenoid 86 is operated based on the driving signal from the control unit 24 (see FIG. 1), so that the arm 82 is lowered. As a result, the nudger roller 56 is moved from the rest position B to the feeding position A.

In the sheet feed tray 52, the stacked sheets P are raised by the raising of the bottom plate (not shown). When the top sheet TP contacts with the nudger roller 56 and the nudger roller 56 is raised, the photosensor 85 detects the protrusion 83 of the arm 82 and the control unit 24 stops the raising of the bottom plate. As the sheets P are sequentially fed, the position of the top sheet TP descends and thus the nudger roller 56 descends. As a result, the photosensor 85 does not detect the protrusion 83 of the arm 82, and the control unit 24 raises the bottom plate. In such a manner, the height of the top sheet TP is controlled so as to fall within the constant range.

Figure 5A:
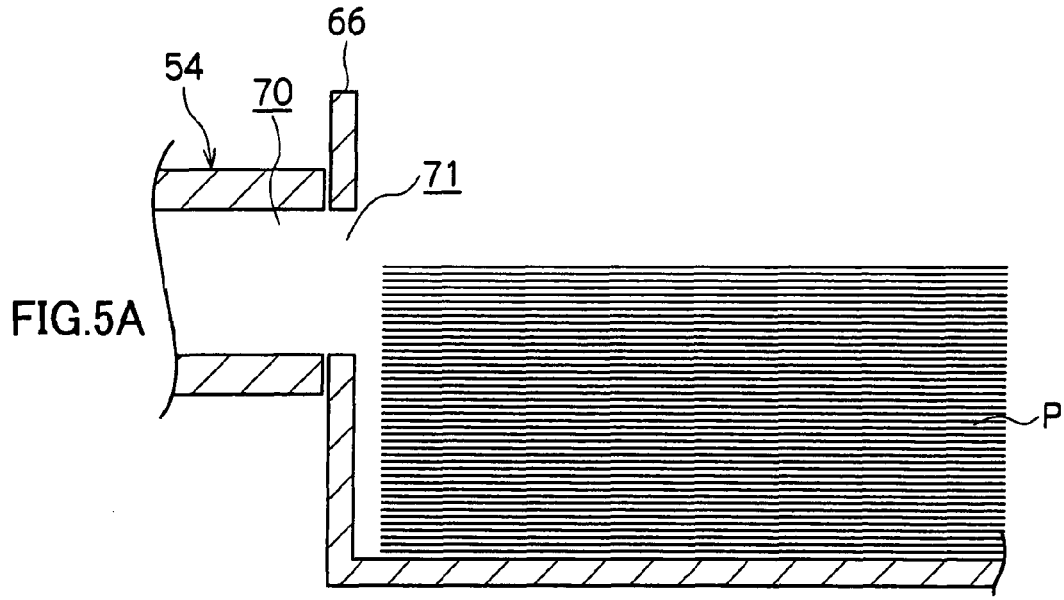
FIGS. 5A to 5C are pattern diagrams illustrating states in which air is blown out of a nozzle of the sheet supply device according to the first embodiment of the invention and sheets are lifted.
Figure 5B:
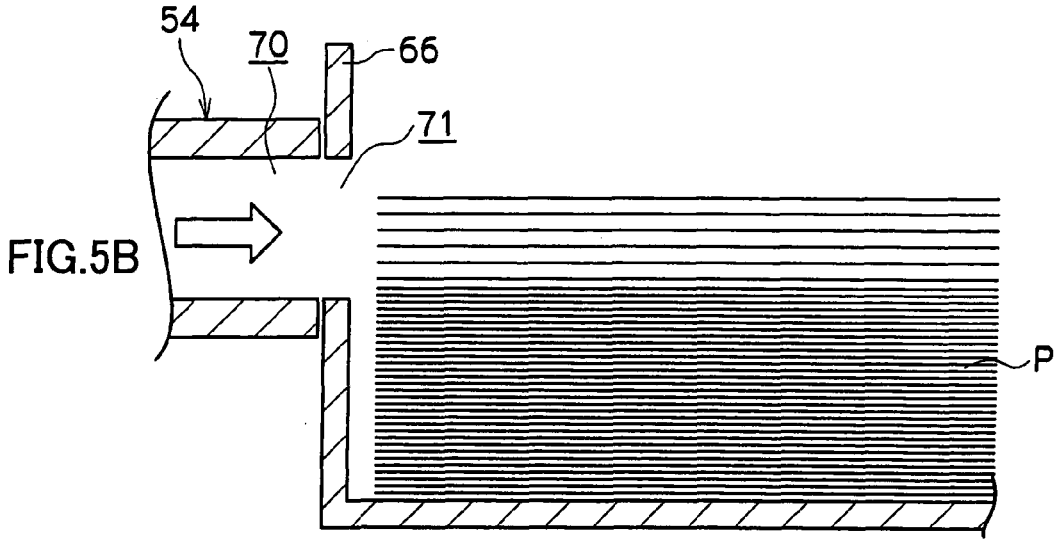
Figure 5C:
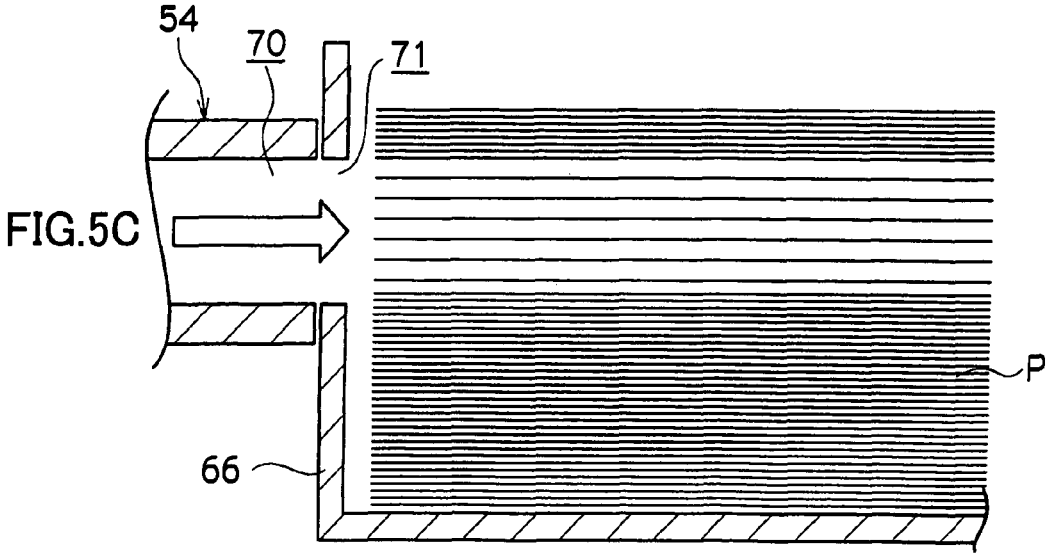

When the air blowing device 54 is driven and operated based on the driving signal from the control unit 24, air is blown at the side surface of the stacked sheets P. When the air is blown the sheets P lift gradually as shown in FIGS. 5A to 5C. When the operation is stopped (becoming inoperative), the sheets P descend gradually (from the state shown in FIG.

5C to the state in FIG. 5A). Further, the air blowing device 54 repeats operation and non-operation for predetermined periods by means of the control unit 24 as shown in FIG. 6. The sheets P repeatedly change from the states shown in FIG. 5A to FIG. 5C and from FIG. 5C to FIG. 5A, so that the adhesion between the sheets P is released more effectively.

As shown in FIG. 4, when the nudger roller 56 rotates in the direction of the arrow shown, it frictionally contacts with the upper surface of the top sheet TP so as to feed the sheets P. The sheets P fed by the nudger roller 56 are held between the feed roller 58 and the retard roller 60, and are sorted into separate sheets to be conveyed downstream one sheet at a time. Since the adhesion between the stacked sheets P is released by the air, double feed wherein plural sheets P are fed in an adhered manner can be prevented.

The solenoid 86 is operated with a timing corresponding to when a sheet P reaches the feed roller 58, whereby the arm 82 is raised so that the nudger roller 56 is moved to the rest position B. As shown in FIG. 6, the feed mechanism 90 feeds the sheets P in synchronization with the operation/non-operation of the air blowing device 54. Specifically, after the air blowing device 54 is changed from an operational state to a non-operational state, the feed mechanism 90 feeds the sheets P. That is to say, the upward-pressing force of the air blowing device 54 pushing up the sheets P is weaker when the feed mechanism 90 is operated (sheet is fed) than when it is not operated (sheet is not fed).

As shown in FIG. 7, therefore, the top sheet TP is fed in a state in which the members above the top sheet TP such as the rise regulating members 62, the nudger roller 56 in the rest position B and the chute member 110 do not rub the upper surface of the top sheet TP, or rub in response to a weak upward-pressing force. Damage to the surface of the top sheet TP is, therefore, minimized, and thus the surface of the top sheet TP is not damaged.

In the present embodiment and other embodiments described below, a time when the air blower is operated may correspond to a time when the sheets are not fed, and a time when the air blower is not operated may correspond to a time when the sheets are fed, as typically shown in FIG. 6. According to this feature, the sheets are fed when the air blower is not operated. That is, the air flow rate is made remarkably low when the sheets are being fed, whereby the function of the second aspect is achieved more effectively.

Figures 8A, 8B, 8C:
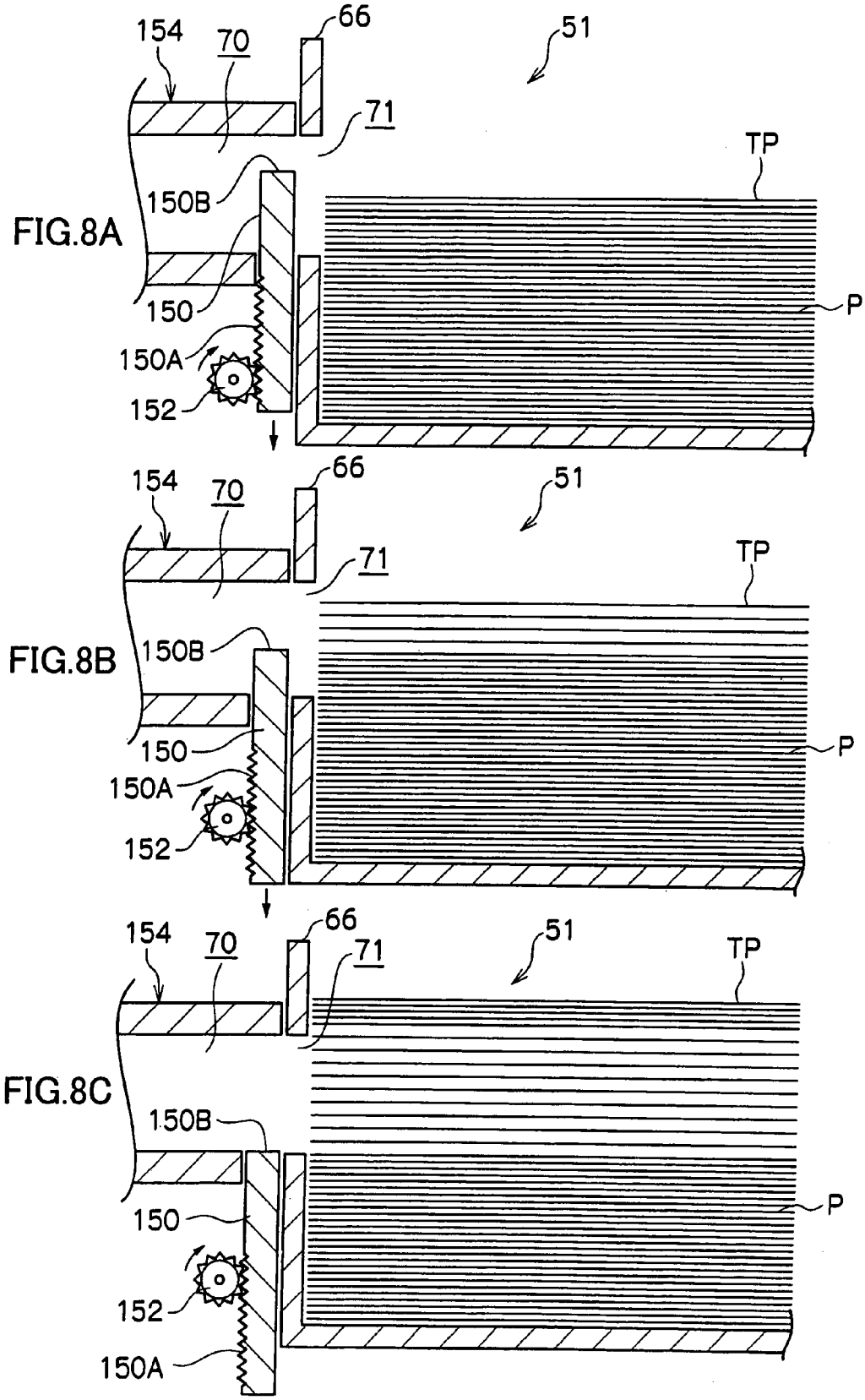
FIGS. 8A to 8C are pattern diagrams illustrating the sheet supply device according to a second embodiment of the invention and states in which a shutter descends and sheets are lifted.

The sheet supply device according to a second embodiment of the invention will be explained below with reference to the drawings. Members identical to those in the first embodiment are designated by the same reference numerals, and explanations thereof will be omitted. As shown in FIGS. 8A to 8C, in a sheet supply device 51, the air blowing device 154 is provided with a shutter 150 between the nozzle 70 and the nozzle 71 of the side surface fixed guide 66. A rack (flat plate gear) 150A is formed on a side of the shutter 150, and is engaged with a gear 152 attached to a shaft of the driving mechanism, not shown. The shutter 150 is supported by a guide rail, not shown, so that it can freely move in a vertical direction.

The gear 152 can rotate in either direction based on a signal from the control unit 24 (see FIG. 1), so as to move the shutter 150 upward and downward. The control unit 24 controls the shutter 150 so that the shutter 150 is moved to an upward or downward position for predetermined periods and is thus repeatedly closed and opened. The function of the sheet supply device 51 according to the invention will be explained below.

FIGS. 8A to 8C illustrate subsequent states in which the shutter 150 is being opened and a boundary delimiting the air blown to the sheets P (in this embodiment, an upper end 150B of the shutter 150) gradually descends so that the sheets P lift accordingly. Conversely, the process of the shutter being closed is approximately illustrated in the reverse order of FIG. 8C to FIG. 8A.

Figure 9:
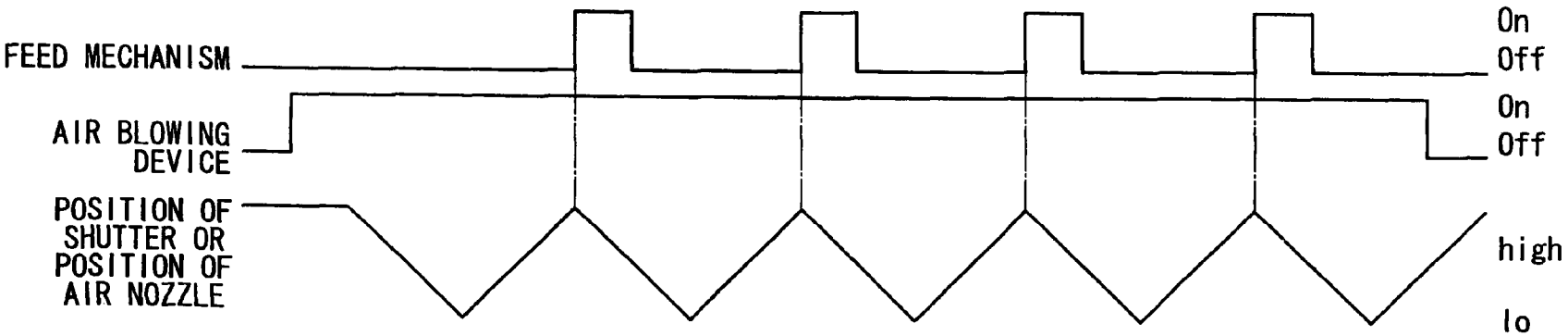
FIG. 9 is a diagram illustrating a position of the shutter in the sheet supply device according to the second embodiment of the invention, a position of an air nozzle of the air supplying device according to a third embodiment, and operation timing of the feed mechanism.

The shutter 150 moves up and down for predetermined periods and the state of the sheets P repeatedly changes from that of FIG. 8A to that of FIG. 8C and from that of FIG. 8C to that of FIG. 8A. As a result, the adhesion between the sheets P is released more effectively. As shown in FIG. 9, the feed mechanism 90 feeds the sheets P in synchronization with the up-down movement of the shutter 150. Specifically, when the shutter 150 reaches the upper position, namely, when the upward-pressing force pushing up the sheets P is at a minimum, the feed mechanism 90 feeds a sheet P.

As shown in FIG. 7, the top sheet TP is fed either without the upper surface thereof rubbing against the members above the top sheet TP such as the lift regulating members 62, the nudger roller 56 in the rest position B and the chute member 110, or while rubbing thereagainst due to a weak upward-pressing force. Damage to the surface of the top sheet TP is, therefore, minimized, and thus the surface of the top sheet TP is not damaged.

The sheets are not necessarily fed when the shutter 150 reaches the uppermost position. It is sufficient to feed the sheets in synchronization with the up-down movement of the shutter 150 such that the height of the shutter 150 is higher when the feed mechanism 90 is operated (feed) than when it is not operated (non-feed). This is because the upward-pressing force pushing up the sheets P becomes weaker when the feed mechanism 90 is operated (supply) than when it is not operated (non-supply). The sheet supply device according to a third embodiment of the invention will be explained below with reference to the drawings. Members identical to those in the first and the second embodiments are designated by the same reference numerals, and explanations thereof will be omitted.

Figure 10A:
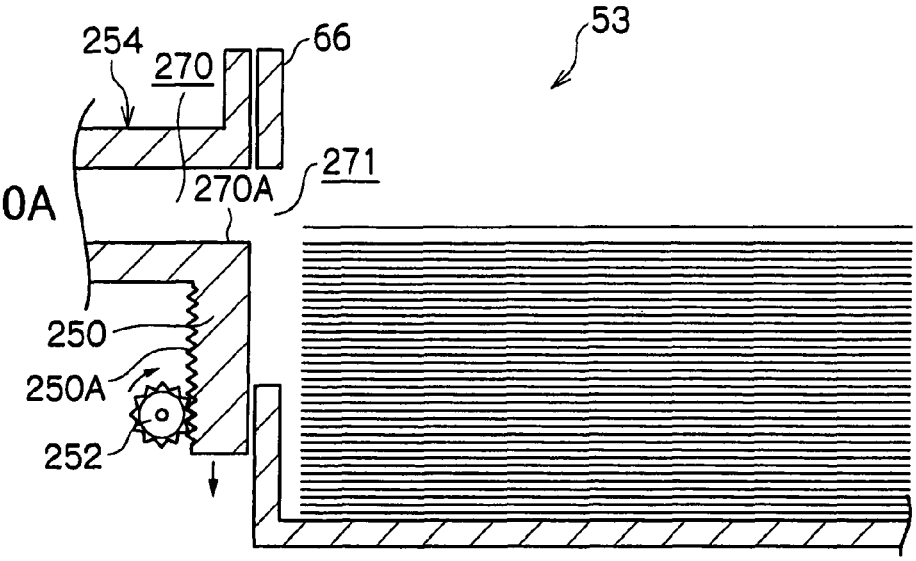
FIGS. 10A to 10C are pattern diagrams illustrating the sheet supply device according to the third embodiment of the invention and states in which the nozzle descends and sheets are lifted.
Figure 10B:
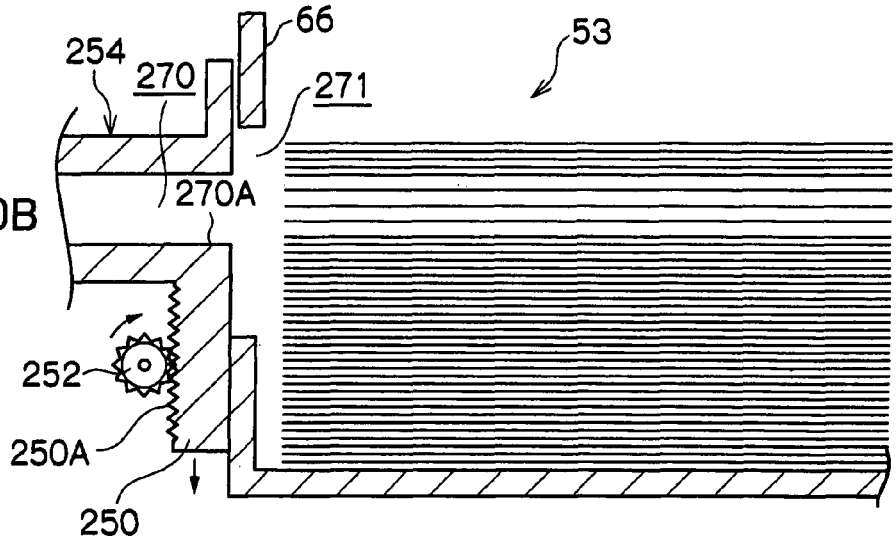
Figure 10C:
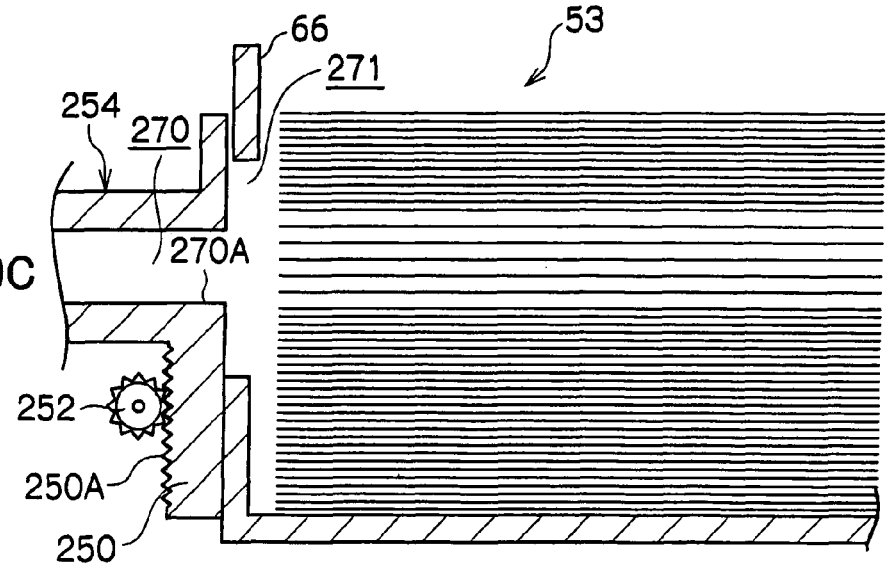

As shown in FIGS. 10A to 10C, in a sheet supply device 53, the dimensions of a nozzle 271 formed on the side surface fixed guide 66 are larger than the dimensions of a nozzle 270 of an air blowing device 254. A protruded contact plate 250 is formed below the nozzle 270 of the air blowing device 254. A rack (flat plate gear) 250A is formed on a side of the protruded contact plate 250, and the rack 250A is engaged with a gear 252 attached to the shaft of a driving mechanism, not shown. The air blowing device 254 is supported by a guide rail, not shown, so that it can freely move in a vertical direction.

The gear 252 can rotate in both directions based on a signal from the control unit 24 (see FIG. 1), such that the air blowing device 254 moves up and down; namely, the nozzle 270 moves up and down. The control unit 24 controls the nozzle 270 (air blowing device 254) such that it moves up and down for predetermined periods. When the nozzle 270 is in the lower position, the upward-pressing force pushing up the sheets P is at a maximum, and when it is in the upper position, the upward-pressing force reaches a minimum. The function of the sheet supply device 53 according to the invention is explained below.

FIGS. 10A to 10C illustrate subsequent states in which the nozzle 270 descends and the boundary delimiting the air blown to the sheets P (in this embodiment, the lower end 270A of the nozzle 270) gradually descends so that the sheets P lift. Conversely, a state of the nozzle 270 ascending is approximately illustrated in the reverse order of FIG. 10C to FIG. 10A. When the nozzle 270 moves up and down for predetermined periods, the air is sequentially blown to the sheets P from the stacked upper sheets P to the lower sheets P, and from the lower sheets P to the upper sheets P. As a result, since, for example, sheets above sheets with weak adhesion can be prevented from being lifted in a bundled state, the adhesion between the stacked sheets P can be released more effectively. Double feed or the like can, therefore, be reliably prevented.

As shown in FIG. 9, the feed mechanism 90 feeds the sheets P in synchronization with the upward-downward movement of the nozzle 270. Specifically, when the nozzle 270 reaches the upper position, namely, when the upward-pressing force pushing up the sheets P is at a minimum, the feed mechanism 90 feeds the sheets P. As shown in FIG. 7, therefore, the sheets P are fed either without the upper surface of the top sheet TP rubbing against the members above the top sheet TP such as the lift regulating members 62, the nudger roller 56 in the rest position B and the chute member 110, or while rubbing thereagainst due to a weak pushing-up force. Damage to the surface of the top sheet TP is, therefore, minimized, and the surface of the top sheet TP is not damaged.

The sheets do not always have to be fed when the nozzle 70 reaches the upper point. That is to say, it is sufficient to feed the sheets P in synchronization with the up-down movement of the nozzle 270 so that the height of the nozzle 270 is higher when the feed mechanism 90 is operated (feed) than when it is not operated (non-feed), because then the upward-pressing force becomes weaker when the feed mechanism 90 is operated (supply) than when it is not operated (non-supply). The sheet supply device according to a fourth embodiment of the invention will be explained below with reference to the drawings. Members identical to those in the first to the third embodiments are designated by the same reference numerals, and explanations thereof will be omitted.

Figure 12:
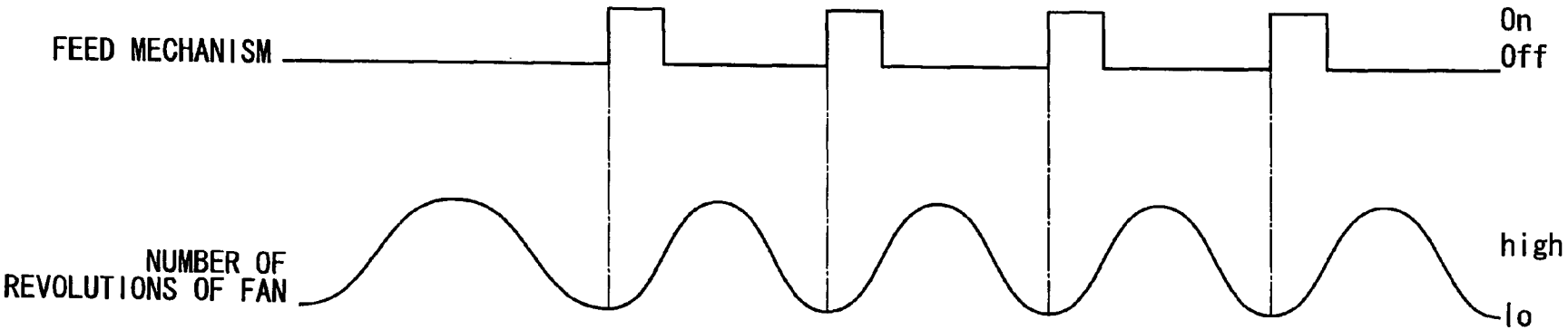
FIG. 12 is a diagram illustrating operation timing between a number of revolutions of a fan in the air blowing device and the feed mechanism of the sheet supply device according to a fourth embodiment of the invention.
Figure 13A:
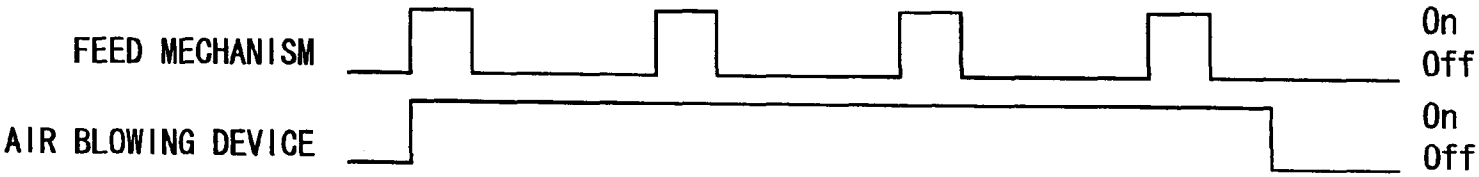
Figure 13B:
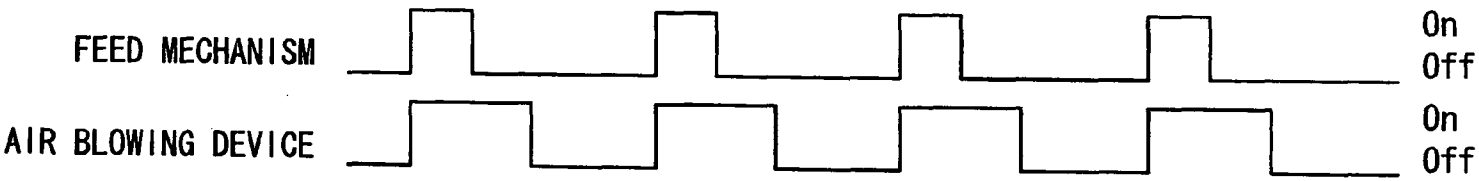
Figure 13C:
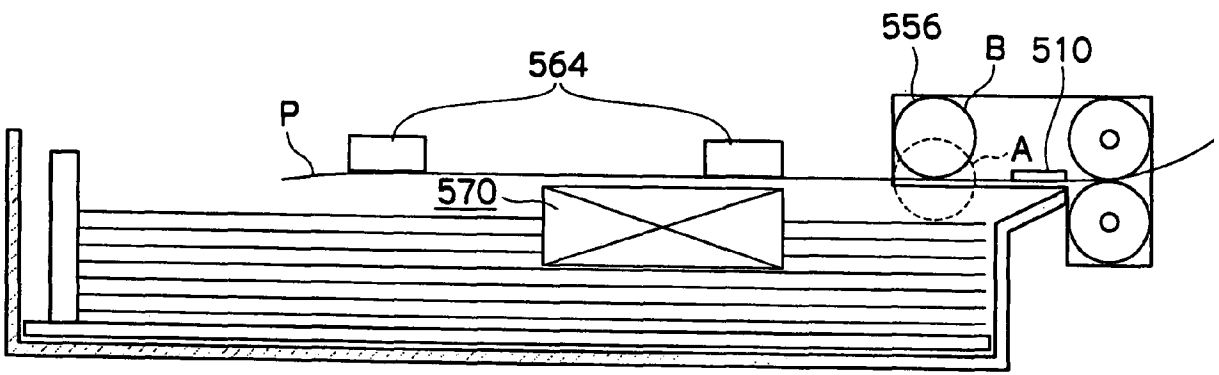

The structure of the sheet supply device is similar to that in the first embodiment, but the control unit 24 (see FIG. 1) controls the driving voltage of the fan 55 (see FIG. 3) so that the number of revolutions of the fan 55 is controlled. Specifically, as shown in FIG. 12, the number of revolutions is controlled such that fast rotation and slow rotation are repeated for predetermined periods. That is to say, the air flow rate is repeatedly increased and decreased for the predetermined periods. The function of the sheet supply device according to the invention is explained below. The fan 55 repeatedly switches between fast rotation (large air flow rate) and the slow rotation (small air flow rate) so that the adhesion between the sheets P can be released more effectively, similarly to in the first embodiment.

As shown in FIG. 12, the feed mechanism 90 feeds the sheets P in synchronization with fluctuations in the number of revolutions of the fan 55. Specifically, when the number of revolutions of the fan 55 is at its lowest (the air flow rate is the lowest), namely, when the upward-pressing force pushing up the sheets P is weakest, the feed mechanism 90 feeds the sheets P. As shown in FIG. 7, therefore, the sheets P are fed either without the surface of the top sheet TP rubbing against the members above the top sheet TP such as the lift regulating members 62, the nudger roller 56 in the rest position B and the chute member 110, or while rubbing thereagainst due to a weak upward-pressing force. Damage to the surface of the top sheet TP is, therefore, minimized, and the surface of the top sheet TP is not damaged.

The sheets P do not have to be fed when the number of revolutions of the fan 55 is at its lowest. The sheets P may be fed in synchronization with a fluctuation or variation in the number of revolutions of the fan 55 so that the number of revolutions is lower when the feed mechanism 90 is operated (feed) than when it is not operated (non-feed), since then the upward-pressing force pushing up the sheets P is weaker when the feed mechanism is operated (feed) than when the feed mechanism is not operated (non-feed). The invention is not limited to the above embodiments. For example, in the embodiments, the nudger roller 56 moves between the feeding position A and the rest position B, but the invention is not limited to this.

Figure 11:
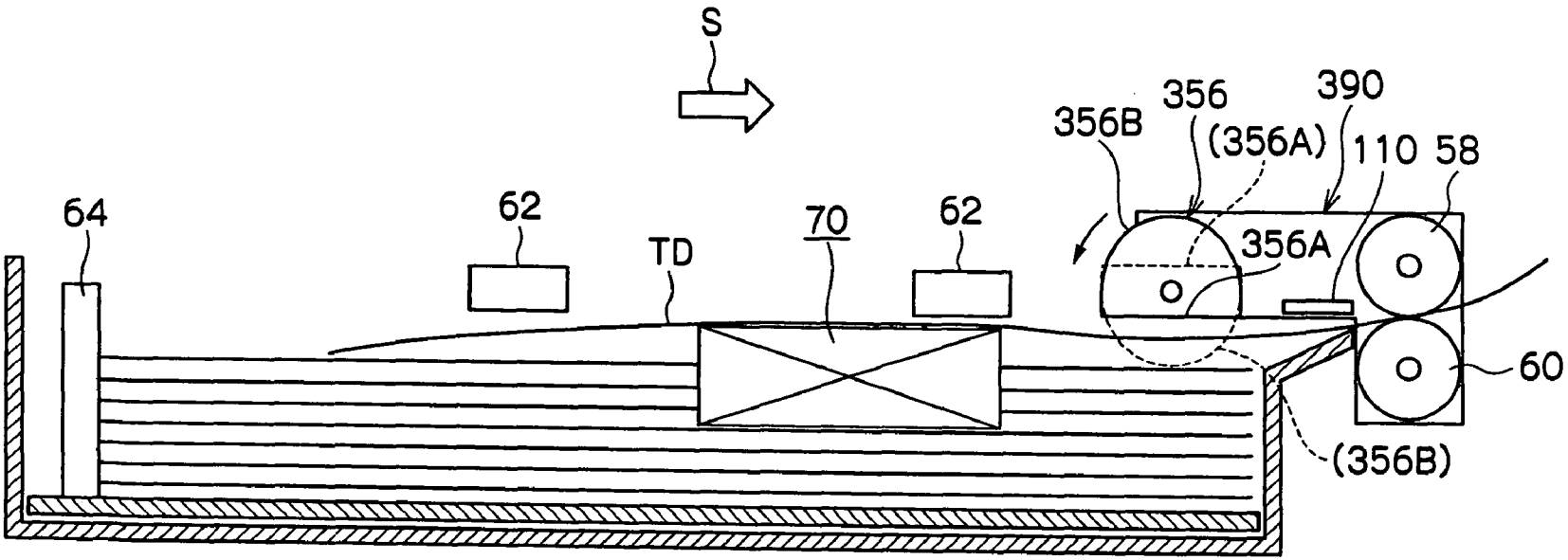
FIG. 11 is a diagram illustrating the feed mechanism that feeds a sheet using a semilunar roller, as a modified example of the sheet supply apparatus of the invention.

For example as shown in FIG. 11, the sheets P may be fed by a semilunar roller 356 the fixed section of which has a D shape. In this case, an arc portion 356B contacts with the top sheet so as to feed the top sheet TP and, thereafter, a flat portion 356A faces downward so that the semilunar roller 356 is disjoined from the top sheet TP and disposed thereabove. The nudger roller may be provided with a rotation allowance mechanism (a mechanism according to which when the nudger roller contacts with the fed sheet, it rotates accordingly) that allows the rotation of a one-way clutch, an electromagnetic clutch, a torque limiter or the like in the sheet feeding direction.

The above embodiments use the well-known electrophotographic process as the image forming system, but the system is not limited to this. For example, the image forming system may be a conventionally-known ink jet recording system or another image forming system.

Although the above-described embodiments of the present invention are those regarding the image forming apparatus, the present invention is not limited to the image forming apparatus. The invention can also be applied to other devices which transport sheets such as cutting machines or press machines.

What is claimed is:

1. A sheet supply device, comprising:

a sheet storing section on which sheets are stacked and are stored;

a sheet feed unit controlled by a controller that feeds the sheets stored in the sheet storing section; and an air blower controlled by the controller that blows air to the sheets stored in the sheet storing section, the air blower has an air nozzle and a mechanism that can adjust a height of the air blower together with the air nozzle in an up-down direction, wherein the air nozzle is repeatedly moved up and down relative to the topmost sheet in feeding cycles and the sheet feed unit feeds the sheets in synchronization with the up-down movement such that the feeding of the sheets begins when the air nozzle is in the highest position, and wherein a force provided by the air blower to push up the sheets is exerted on the sheets, such that less force is exerted when the sheets are being fed compared to when the sheets are not being fed.

2. The sheet supply device according to claim 1, wherein an air flow rate of the air blower is set at a lower rate when the sheets are being fed than when the sheets are not being fed.

3. The sheet supply device according to claim 2, wherein the sheet feed unit is operated after the air blower decreases the air flow rate of the air being blown to the sheets.

4. The sheet supply device according to claim 1, wherein the force for pushing up the sheets exerted by the air blower by blowing the air is varied for predetermined periods, and the sheet feed unit feeds the sheets in synchronization with the predetermined periods.

5. The sheet supply device according to claim 1, wherein the air blower increases or decreases the air flow rate of the air being blown to the sheets.

6. A sheet supply device, comprising:

a sheet storing section on which sheets are stacked and stored;

a feed unit that feeds the sheets stored in the sheet storing section;

an air blower that defines a flow channel to blow air to the sheets stored in the sheet storing section; and a flow channel moving unit that moves the air blower together with the flow channel for the air blown by the air blower, wherein a height of the flow channel in a vertical direction is set to be higher when the sheets are being fed than when the sheets are not being fed, the flow channel moving unit has an air blowing position changing unit that changes a height of an air blowing position with respect to the sheets, the height of the air blowing position is set to be higher when the sheets are being fed than when the sheets are not being fed, and the flow channel is repeatedly moved up and down relative to the topmost sheet in feeding cycles and the feed unit feeds the sheets in synchronization with the up-down movement such that feeding begins when the flow channel is in the highest position.

7. A sheet supply device, comprising:

a sheet storing section on which sheets are stacked and are stored;

a sheet feed unit controlled by a controller that feeds the sheets stored in the sheet storing section; and an air blower controlled by the controller that blows air to the sheets stored in the sheet storing section, the air blower has an air nozzle and a mechanism that can adjust a height of the air blower together with the air nozzle in an up-down direction, wherein the air nozzle is repeatedly moved up and down relative to the topmost sheet in feeding cycles and the sheet feed unit feeds the sheets in synchronization with the up-down movement such that the feeding of the sheets begins when the air nozzle is in the highest position, and wherein a flow rate of the air blower is adjusted so that a force provided by the air blower to push up the sheets is made less when the sheet feed unit is operated compared to when it is inactive.

* * * * *